US005593073A

United States Patent [19]

Finnegan

[11] Patent Number: 5,593,073

[45] Date of Patent: Jan. 14, 1997

[54] WORKMAN'S WRIST BAND

[76] Inventor: Danny Finnegan, 6840 Hickory Ave., Orangevale, Calif. 95662

[21] Appl. No.: 420,096

[22] Filed: Apr. 11, 1995

[51] Int. Cl.[6] ..... A45F 5/00

[52] U.S. Cl. ..... 224/183; 224/219; 224/267

[58] Field of Search ..... 224/183, 219, 224/222, 267, 220, 221, 218; 2/159, 160, 170, 161.6

[56] References Cited

U.S. PATENT DOCUMENTS

| | | | |
|---|---|---|---|
| D. 317,730 | 6/1991 | Mo | 224/183 |
| 3,636,568 | 1/1972 | Stuner | 2/161.6 |
| 3,741,376 | 6/1973 | Brown et al. | 224/183 |
| 4,325,504 | 4/1982 | Amani | 224/183 |
| 4,826,059 | 5/1989 | Bosch et al. | 224/183 |
| 5,022,094 | 6/1991 | Hames et al. | 2/159 |
| 5,130,899 | 7/1992 | Larkin et al. | 224/183 |

*Primary Examiner*—Henry J. Recla
*Assistant Examiner*—Gregory M. Vidovich
*Attorney, Agent, or Firm*—Donald E. Nist

[57] ABSTRACT

The improved workman's wrist band includes an elongated preferably rectangular, flexible resilient strip of woven cloth or the like having opposite end portions and a central portion. To the upper surface of one end portion of the strip is connected an adhesive patch bearing one of a) hooks and b) hook receptors. To the underside of the strip in the opposite end portion is connected an adhesive patch bearing the other of a) hooks and b) velcro-type hook receptors. The patches are used to enable the strip to be releasably affixed around the wrist of a workman. The band also includes a cushion connected to and depending from the underside of the central portion of the strip and having a permanent magnet disposed therein. The magnet releasably holds workman's items such as nails, screws and the like magnetically attracted by the magnet to the upper surface of the central portion of the band for easy access and use. The band is particularly useful for holding nails used in affixing horseshoes to equines. The magnet can be a circular disc or of a different shape and can consist of a plurality of magnetic units magnetically held together for articulation of the magnet for improved wrist comfort. The cushion can have an openable pocket for the magnet so that it can be removed and replaced as needed. The opposite ends of the band can be looped over the central portion of the band to cover nails and the like for transport.

6 Claims, 2 Drawing Sheets

FIG. 1
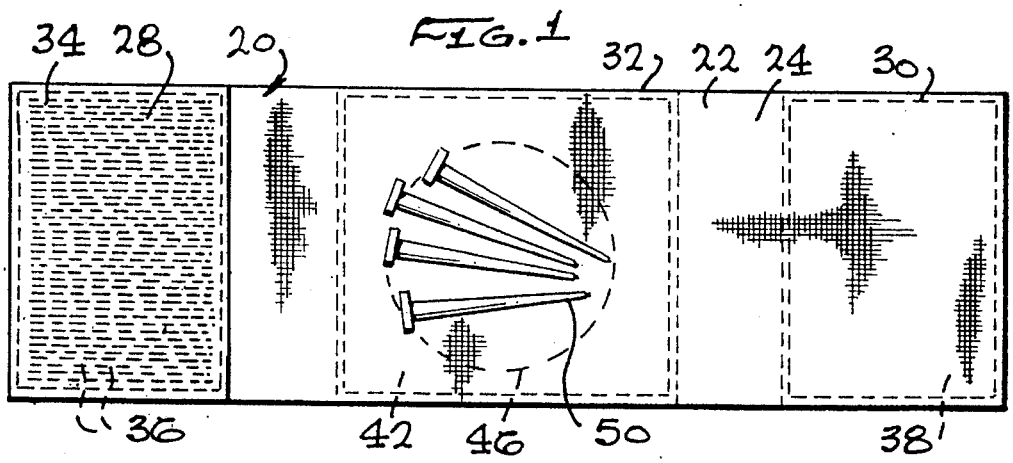
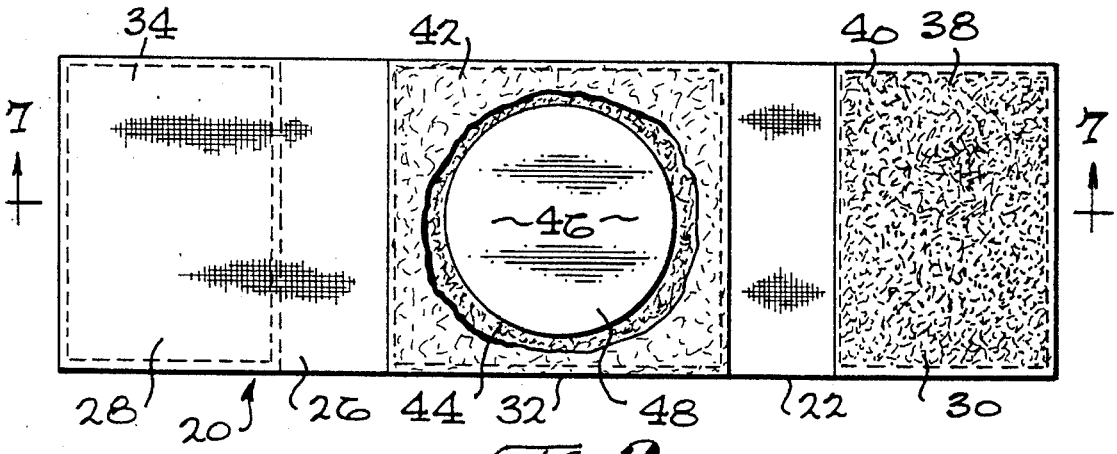
FIG. 2
FIG. 3
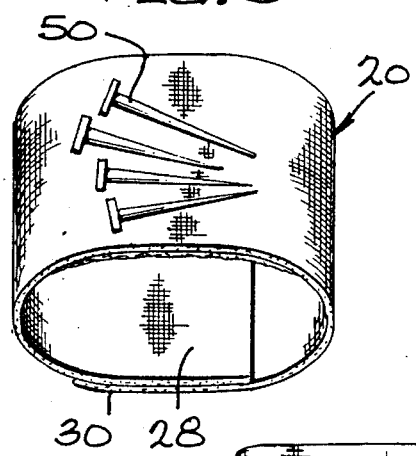
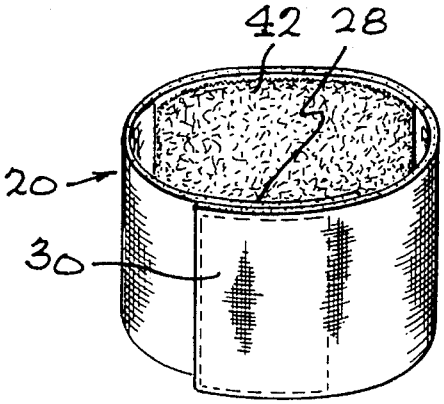
FIG. 4
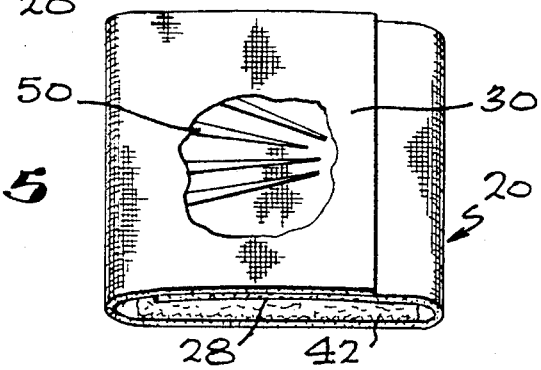
FIG. 5

WORKMAN'S WRIST BAND

BACKGROUND OF THE INVENTION

1. Field of the Invention

The present invention generally relates to accessories for workmen and more particularly to an improved type of wrist band for workmen.

2. Prior Art

Various types of wrist bands have been utilized in the past, mostly for decorative purposes, but in some instances as work accessories. For example, a type of wrist band or bracelet is known which contains a pin cushion on its upper surface. However, this cushion is not useful for holding nails, screws, heavy brads and the like needed by workmen, because the pin cushion would be torn by the nails, screws, brads and the like if they could penetrate the surface of the cushion and they would be difficult to extract from the cushion.

Instead, workmen usually carry nails, screws, brads and the like in a belt pouch or the like from which these items are difficult to extract.

A number of types of sports bands have been used to offer support for the wrist or to serve as sweat bands. However, they are not capable of conveniently holding nails, screws and the like for easy access.

There remains a need for a wrist band which will enable a workman to conveniently hold nails, screws and the like in an exposed readily accessible position for instant use and which can be stored in the pocket when not in use and still bear nails, screws in a secure position. Such wrist band should be inexpensive, durable, compact and easy to wear and remove.

SUMMARY OF THE INVENTION

The improved workman's wrist band of the present invention satisfies all the foregoing needs. The wrist band is adjustable in size, offers support for the wrist, is easy to don and to remove, is durable, inexpensive and can be folded to a compact size for carrying in a pocket or for storage when not in use.

The wrist band releasably holds nails, screws and the like magnetically attractable metallic materials in a convenient position on the top central portion of the band for instant access. Even when the wrist is tilted and swung during work by the workman the metallic items on the top of the wrist band retain their position until used.

The improved wrist band is substantially as set forth in the ABSTRACT OF THE DISCLOSURE. Thus, the wrist band comprises an elongated, preferably generally rectangular, strip of flexible, resilient, durable material such as woven cloth, for example, nylon, or can be of thin leather, plastic, rubber or the like. To one end portion on the upper surface of the wrist band is connected patch bearing one of a) hooks and b) hook receptors.

To the underside of the opposite end portion of the wrist band is connected an adhesive patch bearing the other of the a) hooks and b) hook receptors. With this arrangement not only is the wrist band adjustable in size and can be easily and conveniently connected to and removed from the wrist, but the opposite end portions of the wrist band can be lapped over each other and releasably connected together to cover and protect the upper surface of the central portion of the wrist band.

The wrist band includes a cushion connected to and depending from the underside of the central portion of the strip. This cushion not only improves the comfort and fit of the wrist band on the wrist but contains a permanent magnet which magnetically holds metallic workman's items such as iron, steel or nickel nails and screws and the like on the upper surface of the central portion of the wrist band for instant use by the workman. Movement of the wrist does not dislodge these items and they are protected from dislodging in a workman's pocket when the end portions of the wrist band are lapped over and releasably affixed together by the patches, as described above.

In one embodiment the magnet consists of a number of magnetic units magnetically attracted together to provide the magnet with articulation for a better wrist fit. Thus, the magnetic units may be a plurality of elongated magnets held in side by side relation in the cushion in a position transverse of the main axis of the wrist band. The magnet may be disposed in an openable pocket in the cushion for easy removal and replacement as needed.

Further features of the improved wrist band of the present invention are set forth in the following detailed description and accompanying drawings.

DRAWINGS

FIG. 1 is a schematic top plan view of a first preferred embodiment of the improved wrist band of the present invention, illustrating the position of the magnet therein in dotted outline and showing a plurality of horseshoe nails magnetically attracted to the magnet;

FIG. 2 is a schematic bottom plan view, partly broken away, of the wrist band of FIG. 1;

FIG. 3 is a schematic top plan view, partly broken away, showing the wrist band of FIG. 1 in a wrist locking position;

FIG. 4 is a schematic bottom plan view of the wrist band of FIG. 3 in the wrist locking position;

FIG. 5 is a schematic top plan view, partly broken away, of the wrist band of FIG. 1, shown in the compact folded over stored position with a plurality of horseshoe nails enclosed therein;

DETAILED DESCRIPTION

Figure 6:
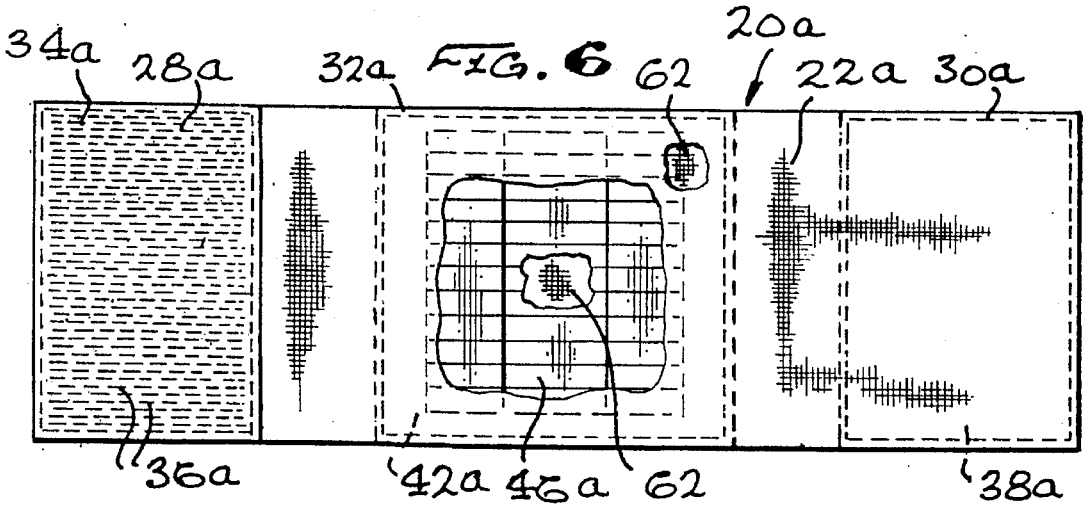
FIG. 6 is a schematic bottom plan view, partly broken away, of a second preferred embodiment of the improved wrist band of the present invention, showing the magnet thereof in an articulated form.
Figure 7:
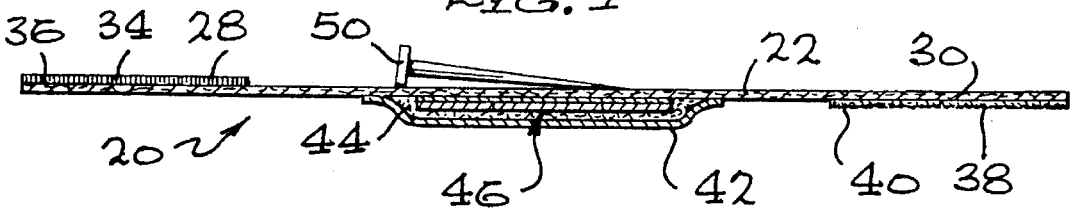
FIG. 7 is a schematic side elevation, partly broken away, of the improved wrist band of FIG. 1, shown with a nail magnetically adhered thereto.

FIGS. 1–5 and 7.

Now referring more particularly to FIGS. 1–5 and 7, a first preferred embodiment of the improved workman's wrist band of the present invention is schematically depicted therein. Thus, wrist band 20 is shown which comprises an elongated, preferably generally rectangular strip 22 of flexible, resilient material, such as a woven cloth, for example nylon or other synthetic material, or plastic, rubber, leather or the like or a combination thereof. Strip 22 has an upper surface 24 and an opposite bottom surface 26 and is divided into opposite end portions 28 and 30 and a central portion 32.

To upper surface 24 at end portion 28 is secured, as by stitching, gluing or the like, an adhesive patch 34, preferably generally rectangular, bearing upstanding hooks 36. To bottom surface 26 at opposite end portion 30 is secured, as by stitching, gluing or the like, a patch 38, preferably generally rectangular, bearing hook receptors 40. It will be understood that patches 34 and 38 could be reversed, as could their positions on end portions 28 and 30.

A cushion 42 is connected, as by stitching, gluing or the like, to bottom surface 26 at central portion 32 of strip 22 and depends therefrom. Cushion 42 can be of leather, such as chamois or the like, or can be of cloth, preferably filled with a cushioning material 44, for example, cotton wadding, down or the like, and containing a magnet 46 in the form of a circular disc 48. Magnet 46 magnetically attracts and holds workman's items such as nails 50 to upper surface 24 of central portion 32 so that they are easily used. Magnet 46 is preferably strong enough to cause nails 50 to adhere to surface 24 even when the workman's wrist to which band 10 is attached moves about in carrying out a work function.

Cushion 42 has the additional function of comfortably cushioning the workman's wrist during use of band 20 and of providing an improved fit of band 20 with that wrist.

In FIGS. 3 and 4 wrist band 20 is shown in the wrist-locking position and, in FIG. 3, with nails 50 fully exposed on the central portion 32 of band 20. FIG. 5 shows wrist band 20 in the compact stored position, with end portions 28 and 30 lapped over central portion 32, end portion 30 directly overlying central portion 32, and with patches 34 and 38 releasably locked together, so that nails 50 magnetically held on central portion 32 are also secured against dislodgement therefrom by end portions 28 and 30. This forms wrist band 20 into a compact shape about one third of its unfolded length and enabling a workman to easily carry wrist band 20 in a pocket, along with nails 50, for maximum convenience. Accordingly, wrist band 20 is inexpensive, durable, easy to use and provides improved performance characteristics for workmen using wrist band 20.

FIG. 6.

A second preferred embodiment of the improved wrist band of the present invention is schematically set forth in FIG. 6. Thus, wrist band **20*a* is shown. Components thereof similar to those of wrist band 20** bear the same numerals, but are succeeded by the letter "a".

Wrist band **20*a* is substantially identical to wrist band 20, except that magnet 46*a* comprises a plurality of magnet units or individual magnets 60 disposed in a rectangular array in side by side and end to end relation and held affixed to an underlying thin flexible sheet 62 of cloth or the like, as by glue (not shown). Thus, magnet 46*a* is articulated in order to provide it with better form fitting to the workman's wrist. Wrist band 20*a* has the other advantages of wrist band 20**.

Figure 8:
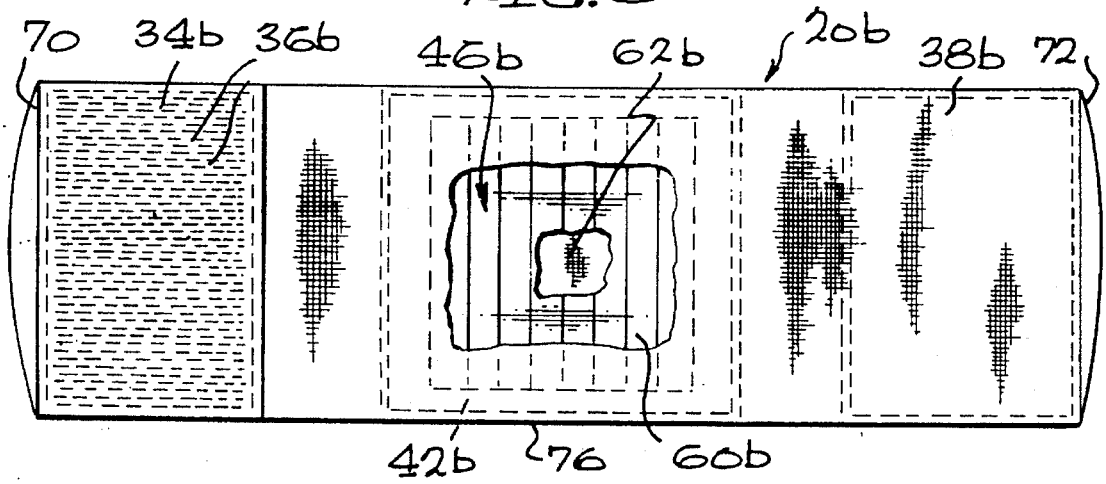
FIG. 8 is a schematic bottom plan view, partly broken away, of a third preferred embodiment of the improved wrist band of the present invention; and, FIG. 9 is a schematic side elevation of the wrist band of FIG. 8.
Figure 9:
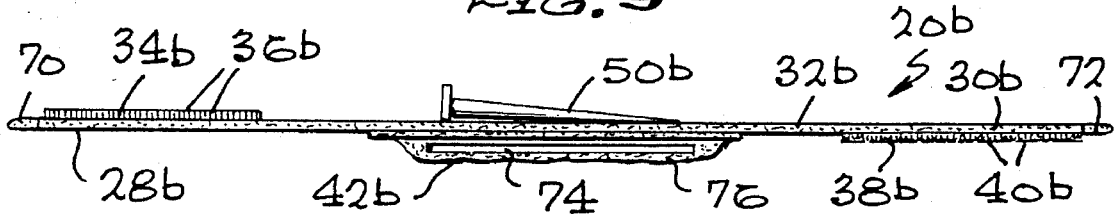

FIGS. 8 and 9.

A third preferred embodiment of the improved wrist band of the present invention is schematically depicted in FIGS. 8 and 9. Thus, wrist band **20*b* is shown. Components thereof similar to those of wrist band 20 or 20*a*** bear the same numerals but are succeeded by the letter "b".

Wrist band **20*b* is substantially identical to wrist band 23**, except as follows:

a) Strip **22*b* has end tabs 70 and 72 to facilitate handling of strip 20*b*;**

b) Magnet **46*b* is similar to magnet 46*a* in that it comprises a plurality of individual mutually attractive magnets 60*b* disposed in side by side relation in a direction transverse of the longitudinal axis of strip 22*b* and adhering to a thin flexible sheet 62*b* of cloth or the like, as by glue (not shown) or the like to provide magnet 46*b* with articulating characteristics; and, c) Cushion 42*b* has a slit 74 in a side 76 thereof through which magnet 46*b* can be installed in and removed from cushion 42*b*. Wrist band 20*b* has the other advantages of wrist bands 20 and 20*a***.

Various other modifications, changes, alterations and additions can be made in the improved wrist band of the present invention, its components and parameters. All such modifications, changes, alterations and additions as ard within the scope of the appended claims form part of the present invention.

What is claimed is:

1. An improved workman's wrist band, said band comprising, in combination:

A) an elongated flexible resilient strip of a length sufficient to fit around the wrist of a workman, said strip having opposite end portions and a wrist spanning central portion between said end portions, said strip having an upper surface and an opposite lower surface, said upper surface bearing on one end portion thereof an adhesive patch connected thereto and having one of a plurality of upstanding hooks and a plurality of hook receptors and said lower surface bearing on the opposite end portion thereof an adhesive patch connected thereto and having the other of said plurality of hooks and plurality of hook receptors, whereby said band is adjustably releasably connectable only around a workman's wrist; and, B) a cushion connected to spanning and depending from said central portion of said lower surface of said strip, said cushion containing at least one permanent magnet, whereby workman's magnetically attractable metallic work items are magnetically adhered to said upper surface of said wrist band for easy access.

2. The improved workman's wrist band of claim 1 wherein said cushion has an openable and recloseable pocket and wherein said magnet comprises a circular disc in and spanning said pocket.

3. The improved workman's wrist band of claim 2 wherein said magnet comprises a plurality of naturally magnetized units adhesive contacting each other whereby said magnet is articulated for an improved wrist fit.

4. The improved workman's wrist band of claim 3 wherein said magnetized units comprise narrow elongated magnets disposed transversely of said wrist band in said cushion.

5. The improved workman's wrist band of claim 1 wherein said strip is dimensioned to releasably magnetically retain a plurality of horseshoe nails.

6. The improved workman's wrist band of claim 1 wherein said strip is of woven cloth, wherein said strip is generally rectangular and wherein said cushion is of padded cloth pocket containing said magnet.

* * * * *